US008764084B2

(12) United States Patent
MacKay Sim

(10) Patent No.: US 8,764,084 B2
(45) **Date of Patent: *Jul. 1, 2014**

(54) RELEASABLE LIFTING LINK

(75) Inventor: Rod MacKay Sim, Epping (AU)

(73) Assignee: Woodstock Percussion Pty Ltd., Epping (AU)

( * ) Notice: Subject to any disclaimer, the term of this patent is extended or adjusted under 35 U.S.C. 154(b) by 39 days.

This patent is subject to a terminal disclaimer.

(21) Appl. No.: 13/408,271

(22) Filed: Feb. 29, 2012

(65) Prior Publication Data

US 2012/0161458 A1 Jun. 28, 2012

Related U.S. Application Data

(63) Continuation of application No. 12/665,467, filed as application No. PCT/AU2008/000757 on May 30, 2008, now Pat. No. 8,172,289.

(30) Foreign Application Priority Data

Jun. 21, 2007 (AU) ..... 2007903323

(51) Int. Cl.
*B66C 1/66* (2006.01)

(52) U.S. Cl.
USPC ..... 294/82.35; 294/89

(58) Field of Classification Search
USPC ..... 294/82.35, 89, 82.34, 82.5; 52/125.5, 52/699, 125.4, 125.2; 24/598.7, 599.3
See application file for complete search history.

(56) References Cited

U.S. PATENT DOCUMENTS 1,365,911 A * 1/1921 Goozey ..... 24/656
3,883,170 A * 5/1975 Fricker et al. ..... 294/82.35
4,173,856 A * 11/1979 Fricker ..... 52/125.5
4,615,554 A * 10/1986 Schilla et al. ..... 294/89
4,627,198 A * 12/1986 Francies, III ..... 52/125.5
4,634,164 A * 1/1987 Fricker ..... 294/89
4,703,595 A * 11/1987 Zipf et al. ..... 52/125.4
4,724,587 A * 2/1988 Foy ..... 24/656
4,769,960 A * 9/1988 Zipf et al. ..... 52/125.4
5,580,115 A * 12/1996 Jessen ..... 294/89

FOREIGN PATENT DOCUMENTS

WO 8201541 A 5/1982
WO 0249953 A 6/2002

OTHER PUBLICATIONS

Intl. Search Report and Written Opinion from PCT Intl Appl. No. PCT/AU2008/00757 mailed Jul. 15, 2008.

* cited by examiner

*Primary Examiner* — Paul T Chin
(74) *Attorney, Agent, or Firm* — Pillsbury Winthrop Shaw Pittman, LLP

(57) ABSTRACT

A lifting link (101) for anchors embedded in concrete panels is disclosed having a shackle (102) with a recessed cross bridge (151). A part circular latch (114) rotates within a chamber (105) of a hollow toroidal ring (104). The chamber has a circular longitudinal axis (119). The upper portion of the ring is formed into a U-shaped slot (113) through which a handle (115) of the latch (114) rotates. A transverse slot (109) accepts the head of anchor (6). The shackle bears against the exterior surface (103B) of the U-shaped slot (113). The radius of curvature of the exterior surface (103B) has a center which is not coincident with the center of the radius of curvature of the chamber axis (119). The part circular latch (114) extends through more than half a circle. Thus the center of lift (125) of the shackle (102) is worked away from the adjacent surface (10) of the concrete panel, thereby saving the surface (10) from damage during lifting.

4 Claims, 9 Drawing Sheets

RELEASABLE LIFTING LINK

CROSS-REFERENCE TO RELATED APPLICATIONS

This application claims benefit as a continuation application under 35 USC 120 of copending U.S. application Ser. No. 12/665,467 filed on 18 Dec. 2009. Application Ser. No. 12/665,467 is a national stage entry under 35 USC 371 of International Application PCT/AU08/00757, filed on 30 May 2008, and which claims Paris Convention priority to Australian application 2007903323, filed on 21 Jun. 2007. The entire contents of each of these applications are incorporated herein by reference.

BACKGROUND

This disclosure relates to a releasable lifting link for connection to a load. In particular the invention relates to a lifting link for connection to an anchoring element embedded in a concrete panel to enable it to be safely lifted without damage from a horizontal to a vertical position. Lifting links for anchors embedded in concrete elements are known to enable the concrete element to be lifted and manoeuvred.

The construction of buildings is facilitated by using walling elements in the form of thin concrete panels. These concrete panel wall elements are most commonly cast in the horizontal position. Panels are often manufactured in factories after which the panels must be transported to the job site for erection. The size of these panels is restricted by the largest size capable of being transported. Economies can be achieved using larger panels cast on-site using the so-called "Tilt-up" method where the panels are cast on the floor slab or a casting bed and erected directly into position as wall elements.

In all cases, the horizontally cast panels must first be tilted up from the horizontal position to the vertical position for their erection as wall panels of the building.

Preferably the panels are lifted by their edges to enable them to be erected in the truly vertical position, however, the stresses induced in the panels as a result of lifting limits the size of panels which can be lifted in this way. When the stresses in the panel exceed the panel strength, the panel must be lifted using an array of anchors cast into the face of the panel. This is most commonly used for the erection of large tilt-up panels.

The smaller panels manufactured in factories can be tilted up from the moulds using anchors located in the edges of the panels. After rotation to the vertical, the panels can be transported around the building site and easily erected in all situations because they hang truly vertically. This is particularly advantageous for panels which are to be attached to framework or other building structures or erected against other components.

Releasable lifting links for connection between embedded lifting anchors and the hoisting chains are known. One known type of link is that disclosed in U.S. Pat. No. 3,883,170 and is used to connect to the head of an anchor having a generally planar body which is embedded in concrete. This anchor incorporates a through aperture to which a latching device incorporated within the releasable link attaches. The anchor is cast within a surrounding recess such that the head of the anchor lies below the surface of the concrete thereby protecting it from damage.

The lifting link has the form of a hollow ring, or a toroidal body, a pivotable shackle element for connection to the hoisting system passing through the internal transverse hole of the toroidal body. The lower part of the toroidal body has a transverse slot which enables it to envelope the head of the anchor. An arcuate latching device is fitted to rotate within the hollow arcuate cavity of the toroidal body.

The latching device has a semi-circular configuration and incorporates a radial arm which extends from one end and which facilitates the rotation of the latching device. The upper periphery of the toroidal body is removed to form a U-shaped slot through which the radial arm passes during rotation.

Connection of the lifting link to the anchor is achieved by rotation of the latching device such that it lies within the hollow body in a position where it does not obstruct the transverse slot in the toroidal body. The toroidal body then envelopes the anchor head such that the curved or arcuate axis of the chamber within the hollow toroidal body is aligned with the axis of the aperture in the anchor head. The arcuate latching ring is then rotated within the chamber of the hollow toroidal body so that it passes through the aperture in the anchor head, thereby connecting the anchor to the lifting link.

WO 82/01541 discloses a lifting link adapted for the releasable connection to anchors cast in the face of concrete panels used for tilt-up construction of site cast wall panels.

SUMMARY

The genesis of the inventive concept is a desire to provide an improved releasable lifting link particularly for the tilting up of concrete panels from anchors located in the edges of the panels.

In accordance with a first aspect of this disclosure, a lifting link for anchors embedded in concrete panels is disclosed in which said lifting link comprising a hollow substantially toroidal ring having a generally central hole, a transverse slot through the base of the ring to receive the anchor, a curved surface at the top of the hole against which a substantially semicircular portion of a shackle or like connector bears, and an arcuate latch which travels in a curved path through the interior of said base and across said slot to engage said anchor, wherein said curved surface is at least partially circular in two substantially normal planes, one of said planes being the plane of said toroidal ring and the other of said plane being radial with respect to said toroidal ring and passing through said top and wherein the wall thickness of said ring is reduced in the vicinity of the top of said hole so that said curved path approaches said curved surface whereby with said shackle lying in said other plane, the centre of lift of said shackle on said ring is moved away from said anchor.

In accordance with a second aspect of this disclosure, a lifting link for anchors embedded in concrete panels is disclosed in which said lifting link comprising a hollow substantially toroidal ring having a generally central hole, a transverse slot through the base of the ring to receive the anchor, a curved surface at the top of the hole against which a shackle or like connector bears, and an arcuate latch which travels in a curved path through the interior of said base and across said slot, wherein said latch has a handle extending beyond said toroidal ring and which is engageable with said shackle when said shackle is substantially vertical, said curved path is substantially circular and the arcuate extent of said latch with said handle engaged with said shackle is sufficient to cause said latch to extend across said slot.

BRIEF DESCRIPTION OF THE DRAWINGS

Various embodiments of this disclosure will now be described with reference to the drawings in which.

DETAILED DESCRIPTION

Figure 1:
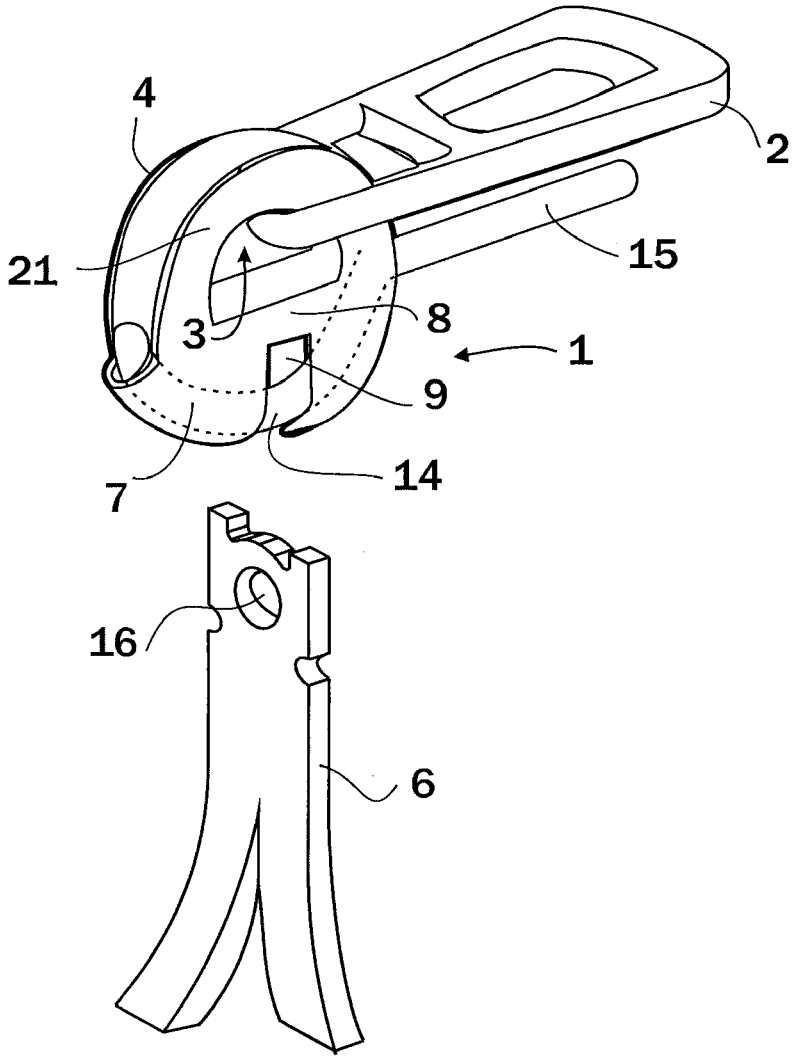
Fig. 1 Prior Art
FIG. 1 is a perspective view of a conventional lifting link and co-operating anchor.
Figure 1A:
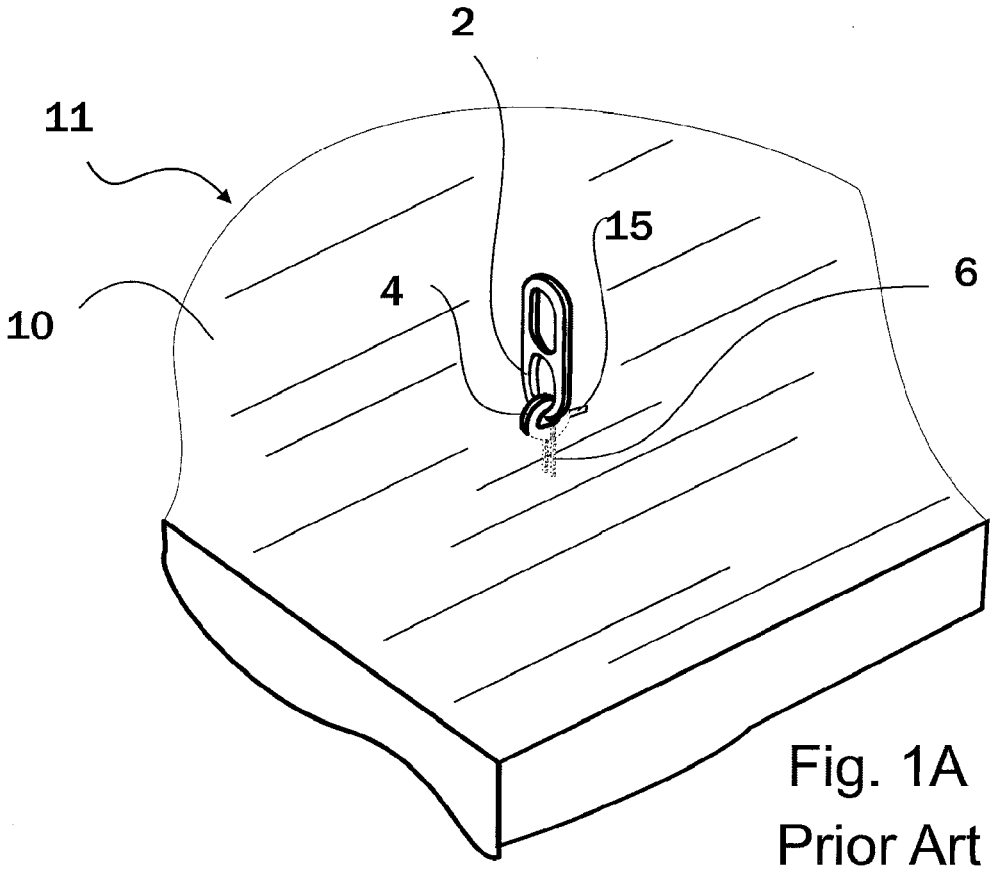
Fig. 1A Prior Art
FIG. 1A is a perspective view of a a conventional lifting link and co-operating anchor embedded in the face of a concrete panel.
Figure 1B:
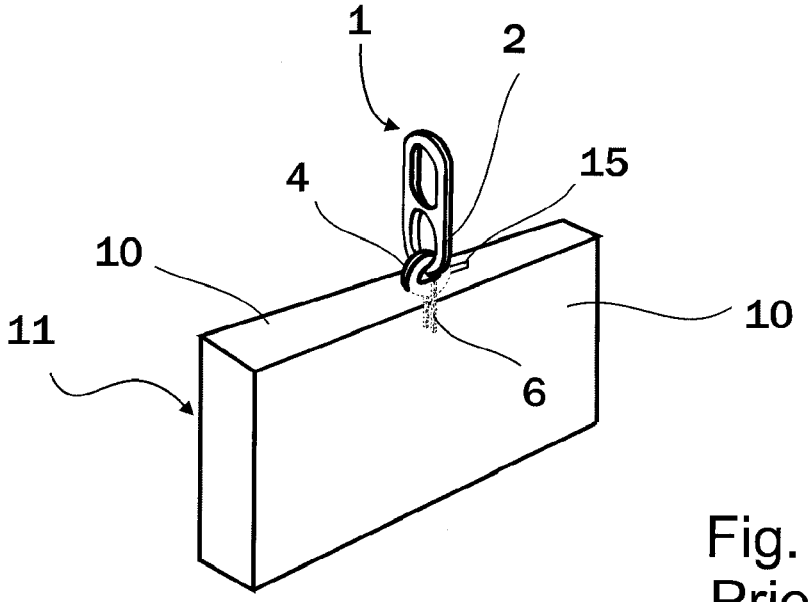
Fig. 1B Prior Art
FIG. 1B is a perspective view of a a conventional lifting link and co-operating anchor embedded in the edge of a concrete panel.

As seen in FIGS. 1-3C, the conventional lifting link 1 is attached to hoisting chains (not illustrated) with a shackle 2 or similar element which passes through a central hole 3 in the toroidal body 4. When the known lifting link 1 is closed over the embedded anchor 6, a lower segment 7 of the toroidal body 4 lies below the surface of the concrete and an upper section 21 lies above the concrete surface 10. The body of the torus is strengthened by a transverse bridge 8 which lies above a transverse slot 9 into which the anchor 6 is mated. The effect of this bridge 8 is to partially close the central hole 3 which results in the central hole 3 having a rounded generally semi-circular profile with its diameter generally flush with the concrete surface 10.

Figure 2A:
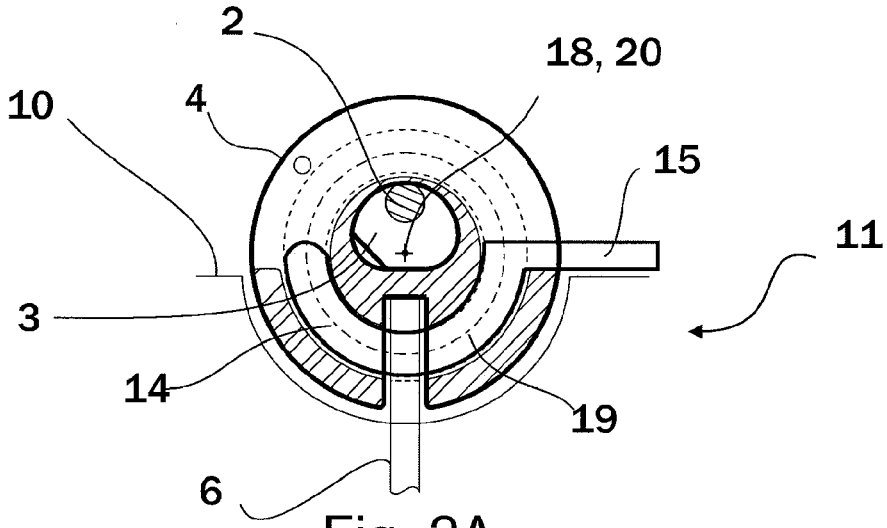
Fig. 2A Prior Art
FIG. 2A is a vertical section through the torus of the conventional lifting link of FIG. 1.
Figure 2B:
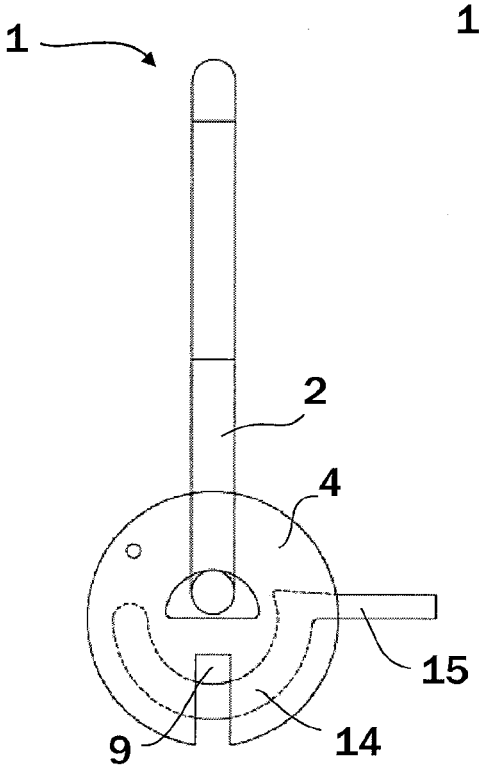
Fig. 2B Prior Art
FIG. 2B is a side elevation of a conventional lifting link.
Figure 2C:
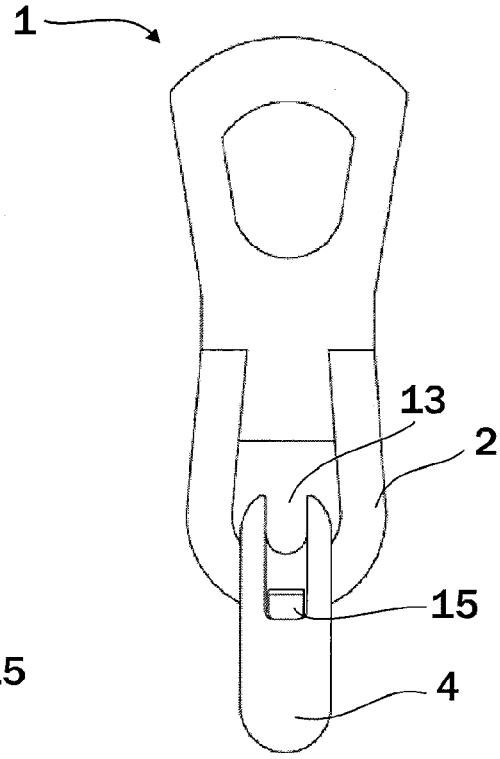
Fig. 2C Prior Art
FIG. 2C is a rear elevation of a conventional lifting link.
Figure 2D:
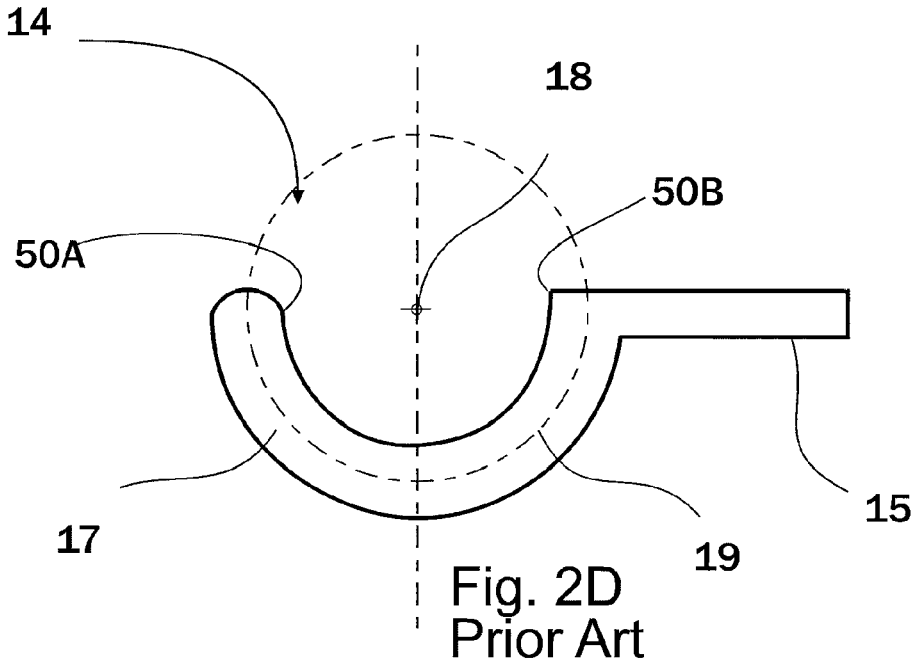
Fig. 2D Prior Art
FIG. 2D is a side elevation of a conventional latching ring.

Within the hollow toroidal body 4 is an arcuate latch 14 (as seen in FIG. 2D) which has an arcuate latching part 17 with an arcuate central longitudinal axis 19 and a radial arm 15. The latch 14 passes through a transverse aperture 16 in the anchor 6 of FIG. 1. The latch 14 is rotatable around the circular surface 3A of the interior cavity 5 shown in FIG. 2E which is concentric with the centre 20 of the toroidal body 4. The inside point of contact 50A (FIG. 2D) lies at a point below the centre 18 whilst the point of contact 50B adjacent to the radial arm 15 lies above the centre 18.

Figure 2E:
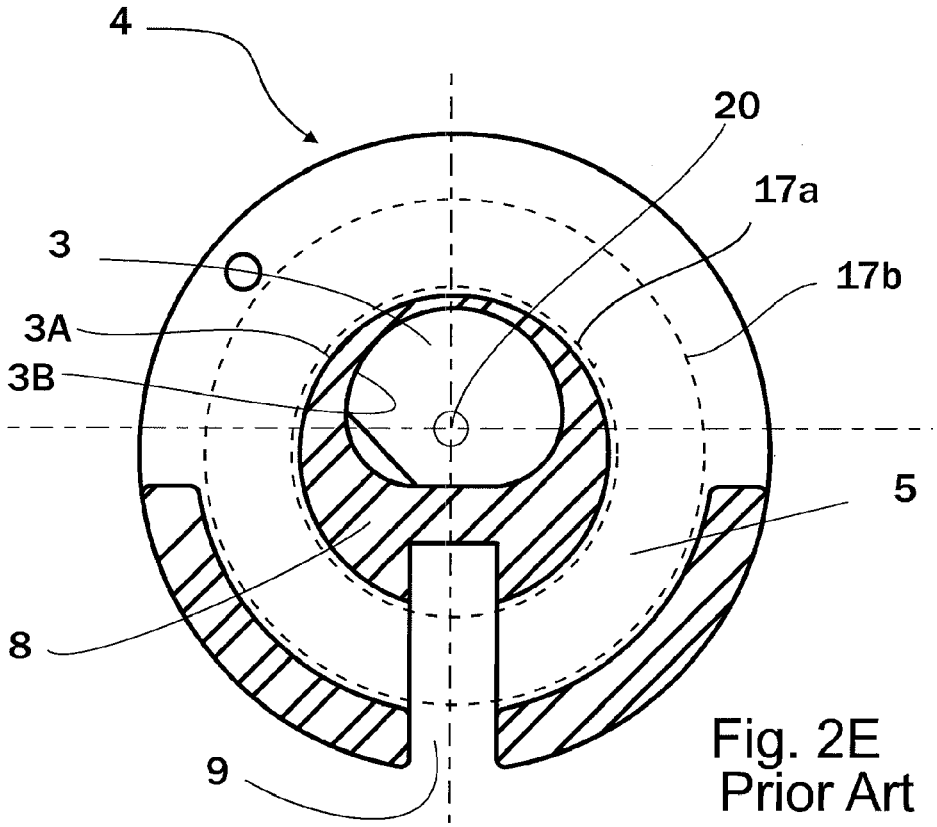
Fig. 2E Prior Art
FIG. 2E is vertical section through the torus of a conventional lifting link.

The latch 14 rotates within the arcuate cavity 5 (FIG. 2E) along a path of rotation described by broken lines 17*a* and 17*b*. The arcuate length of the latching part 17 is substantially one-half of the length of the path of rotation defined by 17*a* and 17*b*. The radius of curvature 19 of the latch 14 and the interior cavity 5 of body 4 are the same and have co-incident centres 18 (FIG. 2D) and 20 (FIG. 2E).

Figure 3A:
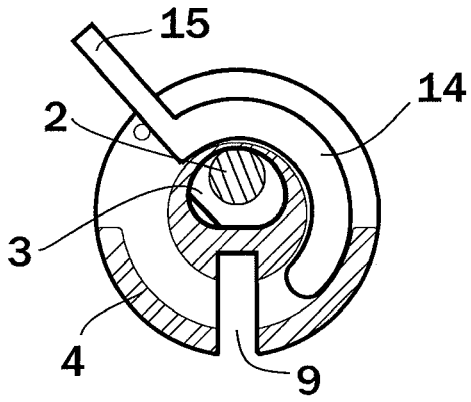
Fig. 3A Prior Art
FIG. 3A is a vertical section of a conventional lifting link with the latching ring rotated anti-clockwise to the fully open position.
Figure 3B:
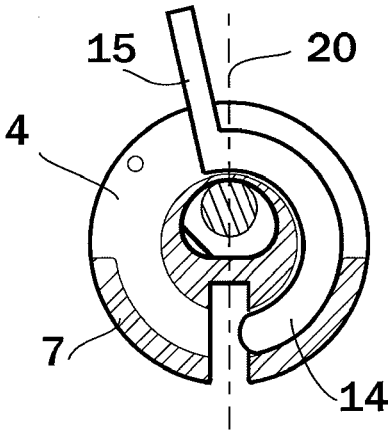
Fig. 3B Prior Art
FIG. 3B is a vertical section of a conventional lifting link with the latching ring rotated clockwise to the partially closed position.
Figure 3C:
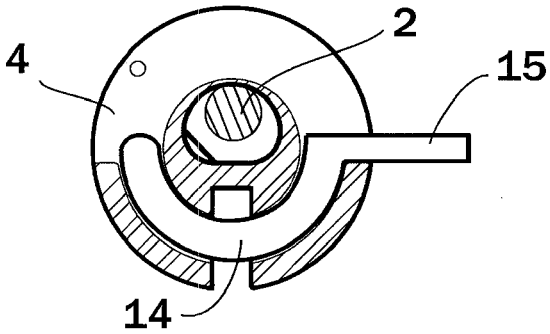
Fig. 3C Prior Art
FIG. 3C is a vertical section of a conventional lifting link with the latching ring rotated clockwise to the fully closed position.
Figure 3D:
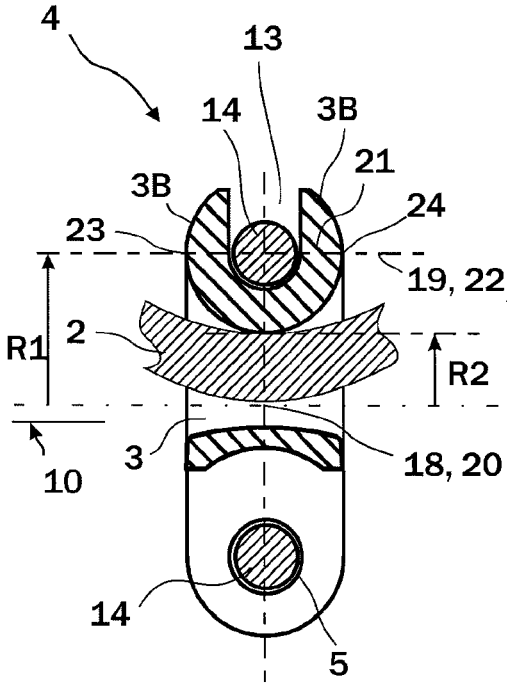
Fig. 3D Prior Art
FIG. 3D is a transverse vertical section of a conventional lifting link and latching ring shown in FIG. 3B.

As seen in FIGS. 2C and 3D the outer peripheral wall of the upper section 21 of the toroidal body 4 is removed to form a U-shaped slot 13, which allows passage of the radial arm 15 during rotation of the latch 14.

As seen in FIGS. 2A-2E and 3D, the shackle 2 passes through the central hole 3 in the toroidal body 4 and bears against the external peripheral surface 3B (FIGS. 2E and 3D) thereof, being free to rotate in all directions above the plane of the concrete surface 10 to facilitate a lifting operation originating from any direction above the concrete surface 10.

As seen in FIG. 3D, the central transverse axis 22 of the upper section 21 of the toroidal body 4 which contains the U-shaped slot 13, lies on the radius of curvature 19 of the latch 14 with co-incident centres 18, 20 of the latch 14 and the toroidal body 4.

The points 23, 24 where the central transverse axis 22 meets the external surface 3B of the upper section 21 of the toroidal body 4 define the widest section of the upper section 21 of the toroidal body 4 and therefore the points 23, 24 are also the end points of an arc of contact between the surface 3B and the shackle 2.

Figure 3E:
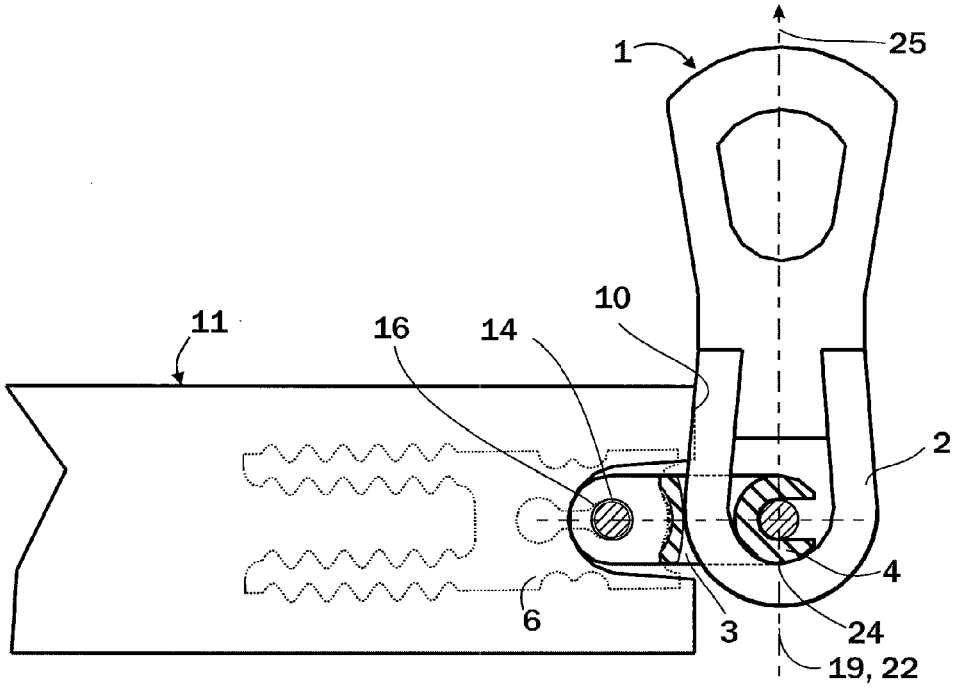
Fig. 3E Prior Art
FIG. 3E is a side elevation of a conventional lifting link at the commencement of the lifting procedure of an anchor embedded in the edge of a horizontal concrete panel, the orientation of the components when the concrete panel reaches its vertical orientation being illustrated in FIG. 3D.

As seen in FIG. 3E, when the shackle 2 is rotated normal to the axis of the aperture 16 in the anchor 6 and parallel to the axis of the central hole 3 in the toroidal body 4, the centre of lift 25 passes through the point 24 and is co-incident with axes 19 and 22.

These conventional lifting links 1 were primarily conceived for the efficient and safe connection to lifting anchors 6 placed in the horizontal top faces of concrete panels (as indicated in FIG. 3 of the abovementioned PCT Specification WO 82/01541) and are based on a design incorporating concentric circles. That is, the external toroidal surface 3B on which the connecting shackle 2 bears, lies on an arc which is concentric with the centre of the toroid 20 and axis 18 of the arcuate axis 19 of rotation of the arcuate latch 14 within the hollow body 4.

The situation where panels are tilted up from the horizontal to the vertical position when links 1 are connected to anchors 6 placed in panel edges is illustrated in FIG. 3E. The shackle 2 is rotated normal to the axis of the aperture 16 in the anchor 6 and parallel to the axis of the central hole 3 in the toroidal body 4. The concentric ring design of these conventional links 1 results in there being little or no clearance between the shackle 2 and the fragile material edge 10 of the concrete panel 11 as seen in FIG. 3E.

Thus, in practice it has been found that the articulating shackle 2 often comes into contact with, and bears against, the panel edge 10 as shown in FIG. 3E resulting in damage to the panel edge 10. This contact is often rapid and creates an inertial impact. This damage requires expensive remedial work, generally after the panel 11 has been erected into its final position in the building where it is difficult to gain access to the damaged portion of the panel 11.

In order to ensure that the lifting link is always free of the delicate edge 10 of the concrete panel 11, there should be a pre-determined distance between all elements of the lifting link and the concrete at all times during the lifting of the panel 11.

Figure 4D:
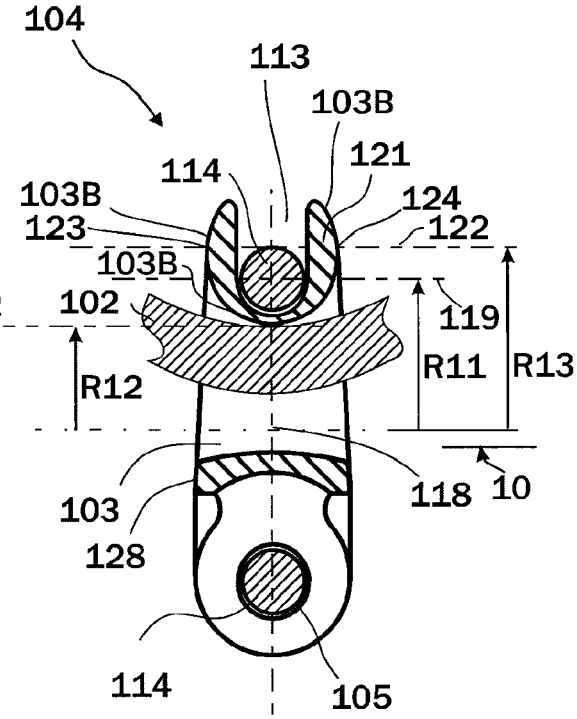
FIG. 4D is an equivalent view to FIG. 3D but illustrates an embodiment of this disclosure.
Figure 4E:
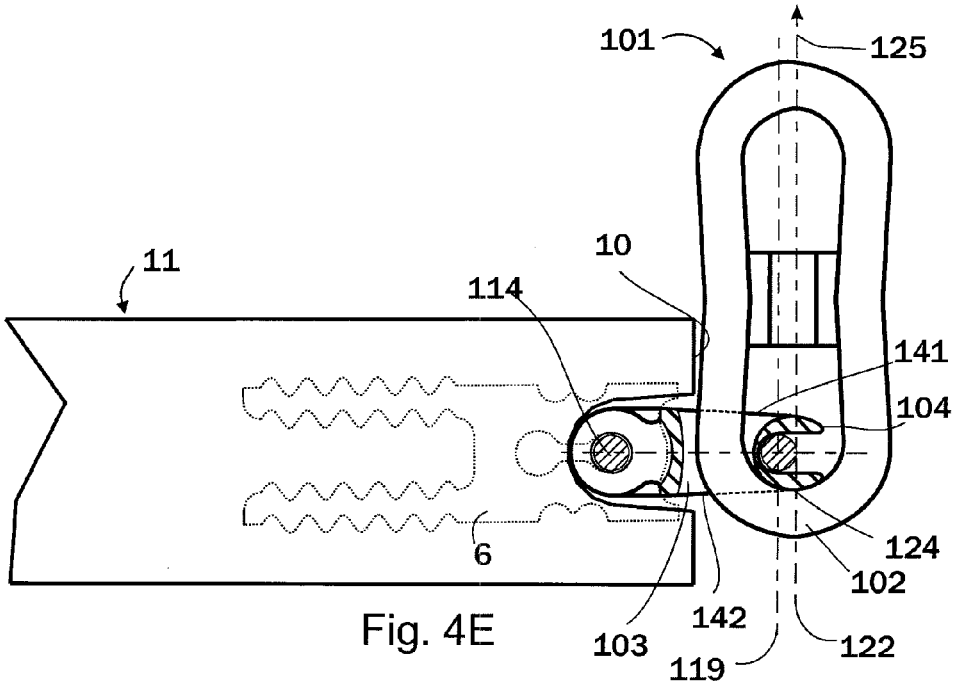
FIG. 4E is an equivalent view to FIG. 3E but illustrating an embodiment of a lifting link of this disclosure.
Figure 4A:
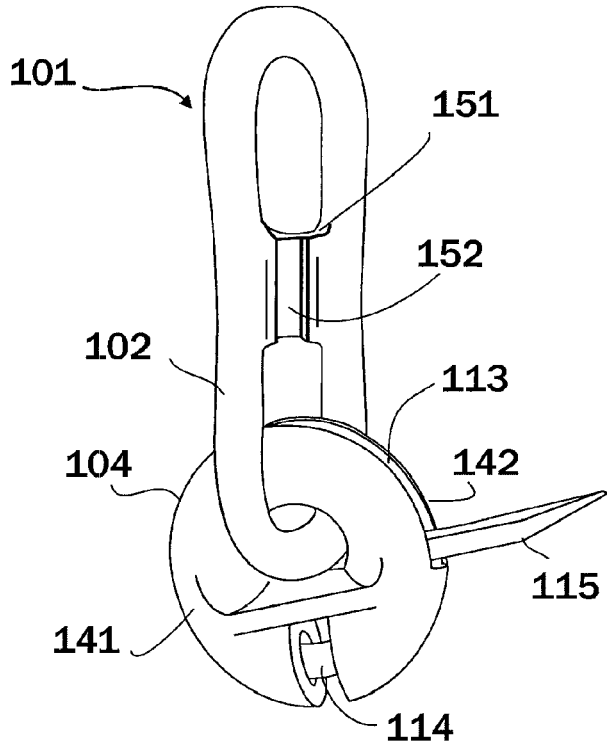
FIG. 4A is a perspective view of an embodiment of a lifting link of this disclosure.
Figure 4B:
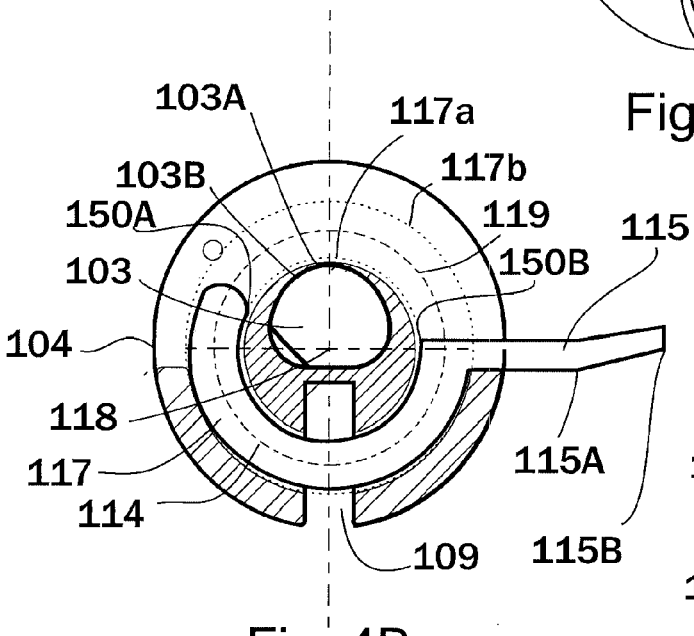
FIG. 4B is a vertical section of the lifting link with the latching ring rotated clockwise to the closed position.
Figure 4C:
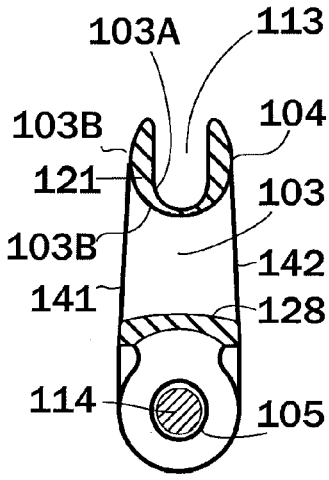
FIG. 4C is a transverse vertical section of the lifting link and latching ring shown in FIG. 4B.

The lifting link 101 of the preferred embodiment is illustrated in in FIGS. 4A-4E and FIG. 5 with like parts having a designation number increased by 100 relative to the prior art. Thus the lifting link 101 has a hollow substantially toroidal body 104 which incorporates a transverse slot 109 which enables it to be closed over the head of the generally planar lifting anchor 6 with which it co-operates. The arcuate latch 114 as seen in FIG. 4B is fitted to rotate along a path of rotation described broken lines 117*a* and 117*b* within the hollow arcuate cavity 105 of the toroidal body 104, on an axis co-incident with the axis of rotation 119 of the latch 114.

The latch 114 incorporates an arcuate latching part 117 having a radial arm 115 which extends from one end and which facilitates the rotation of the latch.

The inside point of contact of the nose 150A of the arcuate part 117 of the latch 114 lies at a point above the centre 118 whilst the point of contact 150B adjacent to the radial arm 115 lies at or just above the centre 118. This ensures that the nose 150A of the latch 114 does not pass across the slot 109 when the latch 114 has been rotated anti-clockwise 90 degrees. As a consequence, the connection between the link 101 remains connected to the anchor 6 when the upper surface of the radial arm 115 bears against the bridge 151 (FIG. 4A) of the link 101, with the link under load. This configuration of the latch ensures that unless the shackle 102 is rotated anti-clockwise as seen in FIG. 4A, the link 101 cannot disconnect from the anchor 6. The inventor has determined that an angle of rotation of the latch handle 115 of greater than approximately 35 degrees anti-clockwise from the vertical position (125 degrees from the fully closed horizontal position as drawn in FIG. 4B) is required before the nose 150A clears the slot 109 thereby providing adequate safety to minimise the risk of accidental disconnection under load. In this connection, it should be borne in mind that the shackle 102 is always vertical when it is under load.

The radial arm 115 is tapered upwards at a point along its length 115A toward its distal end 115B to facilitate the grasping and rotation of the latch by hand by providing a finger space between the distal end 115B and the concrete surface 10.

The upper peripheral wall of the toroidal body 104 is removed to form a U-shaped slot 113, which allows passage of the radial arm 115 during rotation of the latch 114.

Connection of the lifting link 101 to the anchor 6 is achieved by rotation of the latch 114 within the hollow body 104 to a position whereby the latch 114 does not obstruct the transverse slot 109 in the toroidal body 104. The toroidal body 104 is placed over the head of the anchor 6 such that the semi-circular axis of the chamber 105 (FIG. 4C) within the hollow toroidal body 104 and through which the latch 114 passes, is aligned to the axis of the aperture 16 in the anchor 6. The arcuate latch 114 is rotated within the chamber 105 of the hollow toroidal body 104 such that it passes through the aperture 16, thereby connecting the anchor 6 to the lifting link 101.

The central transverse axis 122 of the upper section 121 of the toroidal body 104 which contains the U-shaped slot 113, lies on a radius of curvature shown as R13 in FIG. 4D which is greater than the radius 119 of the latch 114, and co-incident with the centre 118 of the latch 114.

The points 123, 124 where the central transverse axis 122 meets the external surface 103B of the upper section 121 of the toroidal body 104 define the widest section of the upper section 121 of the toroidal body 104 and therefore the points 123, 124 are also the end points of the arc of contact between the surface 103B and the shackle 102.

As seen in FIG. 4E, when the shackle 102 is rotated normal to the axis of the aperture 16 in the anchor 6 and parallel to the axis of the central hole 103 in the toroidal body 104, the centre of lift 125 passes through the point 124 which lies on the axis 122. However, the centre of lift 125 does not pass through the arcuate axis 119 of the arcuate path of the latch 114 along its path of rotation within the cavity 105 of the toroidal body 104.

As seen in FIG. 4D and 4E, the axis 122 of the semi-circular arc defining the interior wall 103B of the central hole 103 of the toroidal body 104, being the wall against which the articulating connecting shackle 102 bears, is deliberately offset from, and not concentric with, the axis 119 of the semi-circular path of the latch 114. This offset between the axis 119 and axis 122 increases the distance between the shackle 102 and the surface 10 of the concrete panel 11. That is, as seen in FIGS. 3D, 4D and FIG. 5, whilst the radii R1 (prior art) and R11 are equal, the radius R13 is greater than radius R1 or R11 and the radius R12 is greater than radius R2 of the prior art.

Preferably, the locus defining the interior wall 103B of the central hole 103 is formed by multiple arcs to form a non-circular central hole 103 (FIG. 4B).

Figure 5:
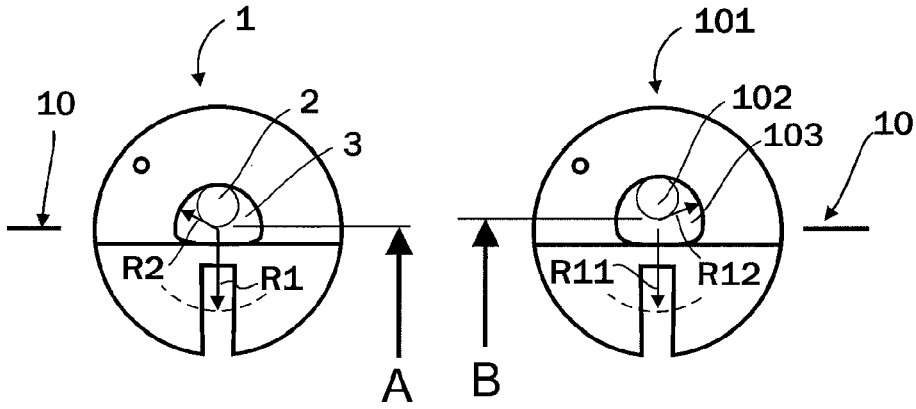
FIG. 5 is a side elevation of the conventional lifting link shown in FIG. 3D beside a side elevation of the link shown in FIG. 4A-4E.

As seen in FIG. 5, the clearance for the link 101 from the concrete face 10 to the adjacent edge of the shackle 102 (indicated by Arrow B in FIG. 5) is much larger than for link 1 (indicated by Arrow A in FIG. 5).

Preferably the side faces 141, 142 (FIG. 4C) of the toroidal body 104 taper inwardly from the top of the bridge 128 which defines the lower boundary of the central hole 103 and the upper section 121 of the link toroidal body 104. This taper increases the clearance between the side faces 141, 142 and the surfaces of the recess of the concrete surrounding the anchor 6.

As seen in FIG. 4A, the preferred embodiment of the link 101 has a shackle 102 which has been fabricated from two U-shaped round bars welded together at their ends together with a transverse bridge piece 151. The shackle 102 is waisted at its centre which also increases the clearance between the shackle 102 and the edge 10 of a thin concrete panel 11 as seen in FIG. 4E.

As seen in FIG. 4A, the bridge piece 151 is positioned to interfere with, and prevent the rotation of, the radial arm 115 of the latch 114 when the shackle 102 is vertical to prevent unexpected disconnection. The bridge piece 151 includes a recessed slot 152 to allow the radial arm 115 of the latch 114 to partially enter, and therefore engage, the bridge piece 151 before it is stopped by the recess 152.

The distal end of the radial arm 115 is angled away from the surface 10 of the panel 11 which has the effect of moving the centre of gravity of the latch 114 in the same direction. Further this provides clearance between the concrete surface 10 and the underside of the radial arm 115 which facilitates grasping of the arm 115 when the radial arm 115 has been rotated in a direction away from the shackle 10 to its closed position, resting against the concrete surface 10. When the radial arm 115 is rotated toward the shackle, its path is blocked by the bridge piece 151. The radial arm 115 comes to rest against the base of the recess 152 in the bridge piece 151. In this position the tapered surface of the radial arm 115 does not protrude beyond the plane defined by the outer surfaces of the loop sections of the shackle 102. This is a useful feature for lifting with the shackle 102 rotated normal to the axis of the anchor 6, and in a direction toward the radial arm 115 since contact between the radial arm 115 and the concrete surface 10 could cause damage to the concrete surface 10, particularly when rotating thin panels 11.

Thus lifting link 104 of the preferred embodiment as seen in FIGS. 4A-4E has a generally toroidal form but with a modified upper section 121 such that the distance (R13) from the centre 118 of rotation of the arcuate axis of the arcuate latch 114 to the point of contact 124 (FIG. 4D) between the shackle element 102 passing through central hole 103 of the toroidal ring 104 and the peripheral surface 103B of the toroidal ring, is greater than the radius (R11) of the arcuate latch 114 from the centre 118 of its arcuate axis.

Figure 6:
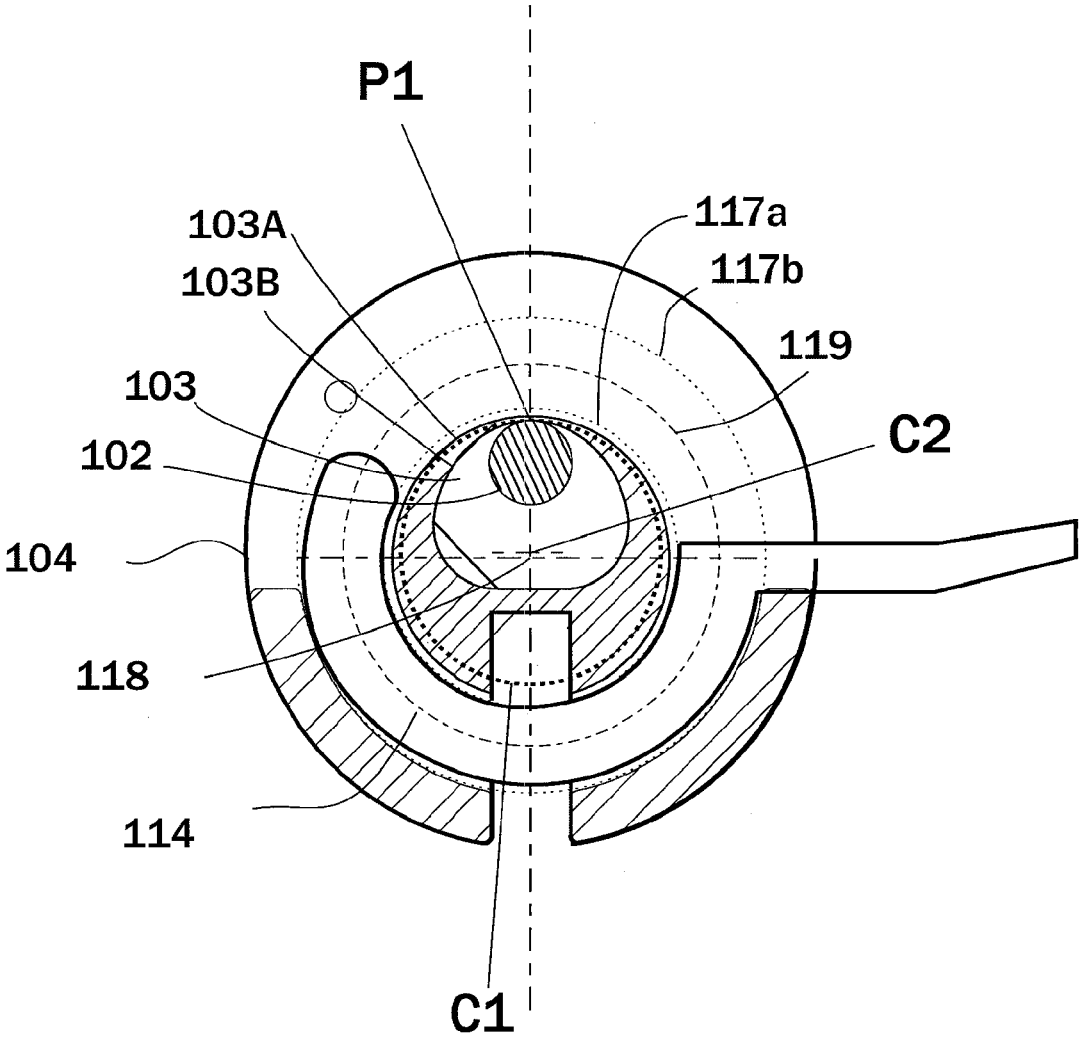
FIG. 6 is a view similar to FIG. 4B and illustrating various geometrical relationships.

In addition, with reference to FIG. 6, a circle C1 (shown as a dotted line) can be drawn passing through the point of contact P1 where the shackle element 102 bears on surface 103B. The circle C1 is not concentric with either the central axis 119 of the arcuate latch 114, or arcuate paths 117A and 117B of the cavity 105 of the toroidal body 104. There is an offset distance, in a direction towards the upper part of the toroidal body 104, between the centre C2 of the circle C1 and the centre of rotation 118 of the arcuate latch 114 and the arcuate paths 117A and 117B of the toroidal body 104.

This offset distance increases the distance between the shackle 102 and the surface 10 of the concrete as seen in FIG. 4E. By this means, a positive clearance by the concrete 11 and the connecting shackle element 102 can be achieved and maintained through all rotations of the shackle.

It will be seen from the above description and drawings that the lifting link 101 takes the form of a hollow substantially toroidal ring 104 with a generally central hole 103. There is a transverse slot 109 through the base of the ring to receive the head of the anchor 6. At the top of the hole 103 there is a curved interior surface 103B against which (as best seen in FIGS. 4D and 4E) a substantially semicircular portion of the shackle 102 bears.

The surface 103B has two opposed saddle points caused by it being part circular in two substantially perpendicular or normal planes. One of these planes is the plane of the ring 104. The other of these planes is the plane of the drawing of FIG. 4E, that is a plane radial with respect to the toroidal ring 104 and passing through the top of the hole 103 (and thus the top of the ring).

It will be seen that the wall thickness of the ring 104 in the vicinity of the top of the hole 103 is reduced or thinned so that the curved path of the latch 114 approaches the curved surface 103B. This has the result as best seen in FIG. 4E that the shackle 102 when lying in the other plane has a centre of lift 122 which is moved radially outwards and thus away from the anchor 6. This results in the improved clearance so that the shackle 102 does not strike the concrete surface 10.

There are several practical factors which must be taken into account in fabricating an acceptable lifting link. For reasons of economy the shackle 102 is normally made from bar having as small a diameter as is practical for the load to be fitted. Also the lifting link must be able to withstand five times the load of the anchor 6. Thus for a link having a working load of 10 tonnes the shackle 102 can be made from 28 mm round steel bar. Thus the internal diameter of the shackle 102 which bears on the ring 104 is 54 mm and its outside diameter is 110 mm.

The wall thickness of the ring 104 cannot be thinned too much at the curved surface 103B lest the thinned wall region buckle inwardly under load (in either the configuration of FIG. 4D or the configuration of FIG. 4E). The remainder of the wall thickness is preferably not thinned in order to maintain the overall strength of the ring 104. Apart from the bearing surface 103B, the remainder of the hole 103 can be of any shape and size so long as it can freely accept the shackle 102.

The foregoing describes only one embodiment of the this disclosure, and modifications, obvious to those skilled in the concrete slab lifting arts, can be made thereto without departing from the scope of the inventive concept.

The term "comprising" (and its grammatical variations) as used herein is used in the inclusive sense of "including" or "having" and not in the exclusive sense of "consisting only of".

What is claimed is:

1. A lifting link for anchors embedded in concrete panels, said lifting link comprising:

a hollow substantially toroidal ring, said ring having a base with an interior, and having a generally central hole with a top, a transverse slot through the base of the ring to receive the anchor, a curved surface at the top of the hole against which a shackle or like connector bears, and an arcuate latch having a free end which travels in a curved path through the interior of said base and across said slot, wherein said latch has a handle extending beyond said toroidal ring and which is engageable with said shackle when said shackle is substantially aligned with said top and slot, and said curved path is substantially circular and the arcuate extent of said latch from said handle to said free end exceeds half of said circular path.

2. The link as claimed in claim 1, wherein with said shackle and handle engaged, said shackle must be moved through and beyond a line interconnecting said top and slot for said latch free end to retract from across said slot.

3. The link as claimed in claim 1, wherein the arcuate extent of said latch is approximately 215°.

4. The link as claimed in claim 2 wherein the arcuate extent of said latch is approximately 215°.

* * * * *